US005503440A

United States Patent [19]

Peccoux

[11] Patent Number: 5,503,440

[45] Date of Patent: Apr. 2, 1996

[54] DEVICE FOR CONTROLLING THE OPENING AND CLOSING OF A PLURALITY OF DOORS, EACH GIVING ACCESS TO AN ENCLOSURE

[75] Inventor: Jean-Marc Peccoux, Besancon, France

[73] Assignee: Schlumberger Industries, Montrouge, France

[21] Appl. No.: 187,619

[22] Filed: Jan. 26, 1994

[30] Foreign Application Priority Data

Jan. 26, 1993 [FR] France ..... 93 00734

[51] Int. Cl.[6] ..... E05C 1/10

[52] U.S. Cl. ..... 292/158; 292/36; 292/DIG. 21; 292/8; 312/218

[58] Field of Search ..... 292/8, 26, 31, 292/35, 36, 41, 158, DIG. 21; 70/DIG. 65; 312/218, 219

[56] References Cited

U.S. PATENT DOCUMENTS 3,371,974 3/1968 Vermeersch ..... 312/218
3,936,108 2/1976 Chitester ..... 312/219
4,092,056 5/1978 Signore et al. ..... 312/218
5,209,168 5/1993 Chapron et al. ..... 292/36

*Primary Examiner*—Steven N. Meyers
*Assistant Examiner*—Tuyet-Phuong Pham
*Attorney, Agent, or Firm*—Frishauf, Holtz, Goodman, Langer & Chick

[57] ABSTRACT

A device for controlling the opening and closing of at least two doors, each enabling access to an enclosure, a single control means adapted to allow separate and controlled access to each of the enclosures. The control means operates locking means for keeping the doors closed or for releasing them, in such a manner that the doors can be simultaneously either all closed at the same time or else at least one open and another closed. The locking means includes, for each door, at least one sliding bolt associated with a receiving seat provided on a corresponding door.

19 Claims, 15 Drawing Sheets

DEVICE FOR CONTROLLING THE OPENING AND CLOSING OF A PLURALITY OF DOORS, EACH GIVING ACCESS TO AN ENCLOSURE

BACKGROUND OF THE INVENTION

The present invention is directed to a device for allowing at least two doors, preferably several doors, to be opened and closed, each enabling access to an enclosure that is to be protected and to which access is to be controlled. More particularly, the device of the invention allows opening and closing of the doors by a single control means.

The invention is particularly applicable to apparatus of the type for dispensing consumable products or cash dispensers or to apparatus adapted to receive payment in coins for a service, such as a travel ticket or for parking a vehicle. The invention is, thus, applicable to dispensing apparatus for consumable goods, cash dispensers, ticket dispensers or parking meters.

Such apparatuses are called upon to contain non-negligible sums of money. Apart from acts of vandalism or breaking in to which such apparatuses are subjected, with the intention of stealing the sums stored therein, they must also be protected against attempts at fraud on the part of the personnel who do have access to the interior of the apparatus, in order for example to carry out repairs or maintenance operations on the devices and systems located inside the apparatuses and necessary for them to operate. By way of example, in the case of an apparatus for dispensing tickets, this contains means for validating the coins introduced, means for collecting the money, means for printing and dispensing a ticket, computing means and any other electronic or software systems for controlling the apparatus. Moreover, it is preferable for the various devices to be placed inside different enclosures and for them to be isolated from one another. Thus, staying with the example of a ticket dispenser, the apparatus is subdivided between three separate enclosures, namely a first enclosure for the collected money (called the "cash-box"), a second enclosure for the part containing the means enabling the apparatus to function, regardless of whether they constitute mechanical or electronic units (called "technical" below), and finally a third enclosure containing the means for printing and dispensing the tickets (called "services" below). It will be understood that, in accordance with their uses and purposes, the devices respectively located in each enclosure should be accessible to different persons. Thus the operations of collecting the money resulting from transactions are independent from maintenance or repair operations on the technical part of the apparatus and equally independent of repair or maintenance visits pertaining to the tickets. These interventions are different in their nature and as a result are carried out both by different personnel and also at very different frequencies. For example, collection of the money may be effected daily, while the tickets need to be replenished every three days, and maintenance and repair operations are carried out on the technical part only on a bi-weekly or monthly basis.

For reasons of security it is important to keep the enclosures mentioned above separate, having regard for the nature and purpose of the devices which they contain. Thus, it is important to avoid any attempts at fraud on the apparatus on the part of personnel called upon to intervene in and access the interior of the apparatus, with the intention of misappropriating funds or acting fraudulently in relation to tickets and/or the operating means of the apparatus.

It is thus necessary to regulate and control access to the respective enclosures in such a manner as to allow access to each of them only by authorized personnel. By way of example, a person entrusted with maintenance or repairing the service part (tickets) does not normally need to intervene in the operating means of the apparatus (technical part) nor in the collecting means (cash-box).

In this sort of apparatus it is known to provide an access door for each of the enclosures, each door being fitted with a lock operated by its own key. Thus, a ticket dispenser is provided in known manner with several distinct doors, adapted to be opened by means of their own different keys, so that several different keys are associated with each apparatus. It will readily be understood that the management of such a closure system becomes extremely complex when the number of apparatuses becomes relatively large.

Another known solution consists in providing a single enclosure provided with a single door and comprising a space inside defining a sub-enclosure containing the cash-box for example and accessible by means of another key. Although, by giving the person in charge of the cash-box the two keys, this known system allows prevention of access to the cash-box by personnel only having the key to the main door, by definition it does not prevent the person responsible for the cash-box having access to the rest of the apparatus, which can lead to the above-mentioned consequences. Another disadvantage of the single door is that this has to be large, in order to allow ready access to the enclosures or to the single enclosure defined inside the apparatus, which increases the danger of injury for persons on account of the large area and the long edges of the door.

Thus, in the prior art, whether the apparatus is equipped with a plurality of doors each operated by its own key, which allows the area of each door to be reduced and thus its vulnerability to be reduced, but which leads to the disadvantage of very complex management, or whether it is equipped with a single door giving access to different doors located inside, which makes the main door vulnerable, the problem of separate access to each enclosure inside the apparatus is not fully solved.

Known devices that allow the opening and closing of doors, each of them giving access to one enclosure, do not provide satisfaction and require the manufacturer of such apparatus to make a compromise between the contradictory requirements explained above.

SUMMARY OF THE INVENTION

One object of the present invention is to overcome the above-described problem by providing a device for closing and opening a plurality of doors, each associated with an enclosure (of an apparatus of the nature of a ticket dispenser for example) and enabling the access to each of the enclosures, and thus to the devices contained therein, to be regulated and controlled according to a predefined order and hierarchy, in order to avoid any fraud on the part of personnel required to attend to the devices located in the respective enclosures.

To this end, according to a first aspect of the invention, the device for controlling the opening and closing of at least two doors, each giving access to an enclosure, comprises a single control means adapted to allow separate and controlled access to each of said enclosures, and adapted to operate locking means for keeping the doors closed or for releasing them, in such a manner that the doors can be simultaneously either all closed at the same time or else at least one open and another closed, said locking means comprising, for each door, at least one sliding bolt associated with a receiving seat provided on said corresponding door.

In a preferred implementation of the invention, the locking means comprise, for each door, a bar mounted to move substantially parallel to the edge of the opening of said enclosure and provided with at least one finger (forming a bolt) and adapted to enter into the said receiving seat provided on the door, and the said control means comprise a rod mounted to move parallel to itself and provided, at its ends, with articulated connecting means adapted to cause the movement of the bars parallel to themselves.

Preferably, the bar provided with at least one finger is disposed vertically and is adapted to move in a substantially vertical direction, and the said rod is mounted horizontally and the said connecting means are each formed by a lever in the shape of an L, of which the free end of one arm is pivoted to said rod and the free end of the other arm is coupled to a slider integral with said bar.

The fingers (forming bolts) are advantageously of different lengths from one door to the other. Likewise the bars are adapted to be moved on the one hand in an incremental manner and on the other hand in different directions from one door to the other. Likewise, the fingers can be directed in different directions (for example down and up respectively) from one door to the other.

Several bolts are advantageously provided on each bar and several corresponding openings are provided on each door.

In an advantageous manner, the device comprises additional locking means operable independently, of the main locking means of one of the doors, in a manner allowing at least one door to be maintained in closed position, regardless of the state of the main locking means.

The apparatus of the present invention is also well protected against vandalism such as break-ins into such apparatus by force. The technical means normally employed, such as reinforcement and use of very strong metals, do not provide an adequate protection against these acts of vandalism or break-ins into these apparatuses especially because these apparatuses are located outdoors and are, thus, vulnerable.

Means for closing a door are known comprising bolts fixed to the door and sliding in the plane thereof and adapted to enter into corresponding seats located in the door frame. The number of bolts provided may amount to five, namely three located in the vertical area and two others located on the lower and upper horizontal areas, respectively. These bolts are moved simultaneously by the lock, under the action of a key. The efficiency of this known system is dependent on the clearance between the door and door frame. Thus, the presence of clearance, however small, allows the introduction of a tool, such as a screwdriver or a jimmy, into the clearance of one or more millimeters, which makes it possible to develop forces of as much as 10 tons by the lever action. Under the assumption that the clearance is extremely small and does not allow introduction of a jimmy, direct attack on the material of the door and the door lining at their junction makes it possible to create enough clearance to introduce the jimmy.

Thus, known bolt systems at best enable unauthorized opening to be delayed. Moreover, these devices are relatively expensive, taking into account the relatively complex mechanism for shifting a plurality of bolts by a single lock. This complexity equally affects the strength of the assembly and, thus, makes it necessary to reinforce the same by using extremely strong materials, which is costly. The high cost is incompatible with the economic requirements which lead to the use and manufacture of dispensers, for example of the type mentioned above.

Known proposals for overcoming these problems consist in fitting the door with at least one, for example three, tongues which project from the plane of the door. These tongues are located in the plane of the edge of the door. In the example of a door of rectangular shape, the tongues are preferably located on a vertical edge and are parallel to the hinge axis of the door. The tongues are adapted to enter into seats provided on the wall of the enclosure and of complementary shape to the tongues. The tongues, once they are in closed position, pass through the wall (through the said openings). The tongues comprise, respectively, openings so located as to pass through the wall of the enclosure when in the closed position. Locking means, in the form of fingers of suitable shape, are adapted to be moved between a retracted position, unlocking the door, and a closed position in which the fingers penetrate inside the openings in the tongues, thus locking the door. The openings provided in the wall of the enclosure to be protected are of a generally rectangular shape. The movable locking fingers are generally L-shaped and perform a movement combining a vertical shift with a horizontal shift. The resultant is very close to movement on an arc of a circle or an arc of an ellipse.

This known device is satisfactory. However, it is capable of improvement with a view to increasing its resistance to break-ins. Thus, the movement of the locking fingers makes it necessary to rely on a complex actuating mechanism operated by the lock. Furthermore, the tongues, having regard to their location on the door, have a minimum size which is difficult, if not impossible, to reduce below a certain limit without affecting their strength. As a result, the number of tongues which can be located on the same door cannot be increased indefinitely. Thus, the resistance of a door provided with a device of this known type has a certain limit, even although it is already relatively high. However, the demands to which the apparatus on which such doors are fitted are high and have tended to become higher from year to year, having regard especially to the fact that users are demanding ever increasing reliability of such apparatus, and above all because of the increase in the power of means for breaking in.

It is, thus, desirable to be able to increase the resistance to break-ins of the doors provided on apparatuses of the type referred to above, which are located in the open or in places accessible to the public.

Another object of the present invention is to overcome the problems of the known systems and to provide a device enabling the closed position to be maintained with a high degree of security, delaying the opening of the device by break-ins. The resultant effect is dissuasive and leads to its abandonment by the person making the break-in.

To this end, a locking device is provided for a door adapted to close an opening provided in a container. The locking device includes at least one tongue with an opening, at least one receiving seat adapted to receive the tongue, and at least one bolt connected to a lock and adapted to be moved between a retracted, open position and a closed position in which the bolt enters into the opening. The tongue and the associated seat are located in a plane making an angle other than 0° or 180° with the tangent to the edge of the opening, and preferably in the order of 90°. The tongue is advantageously located on the door, and the bolt and the lock are located on the container.

BRIEF DESCRIPTION OF THE DRAWINGS

The invention will be better understood in the light of the following description of non-limitative examples of implementation, with reference to the accompanying drawings, in which.

DETAILED DESCRIPTION OF THE INVENTION

Figure 1:
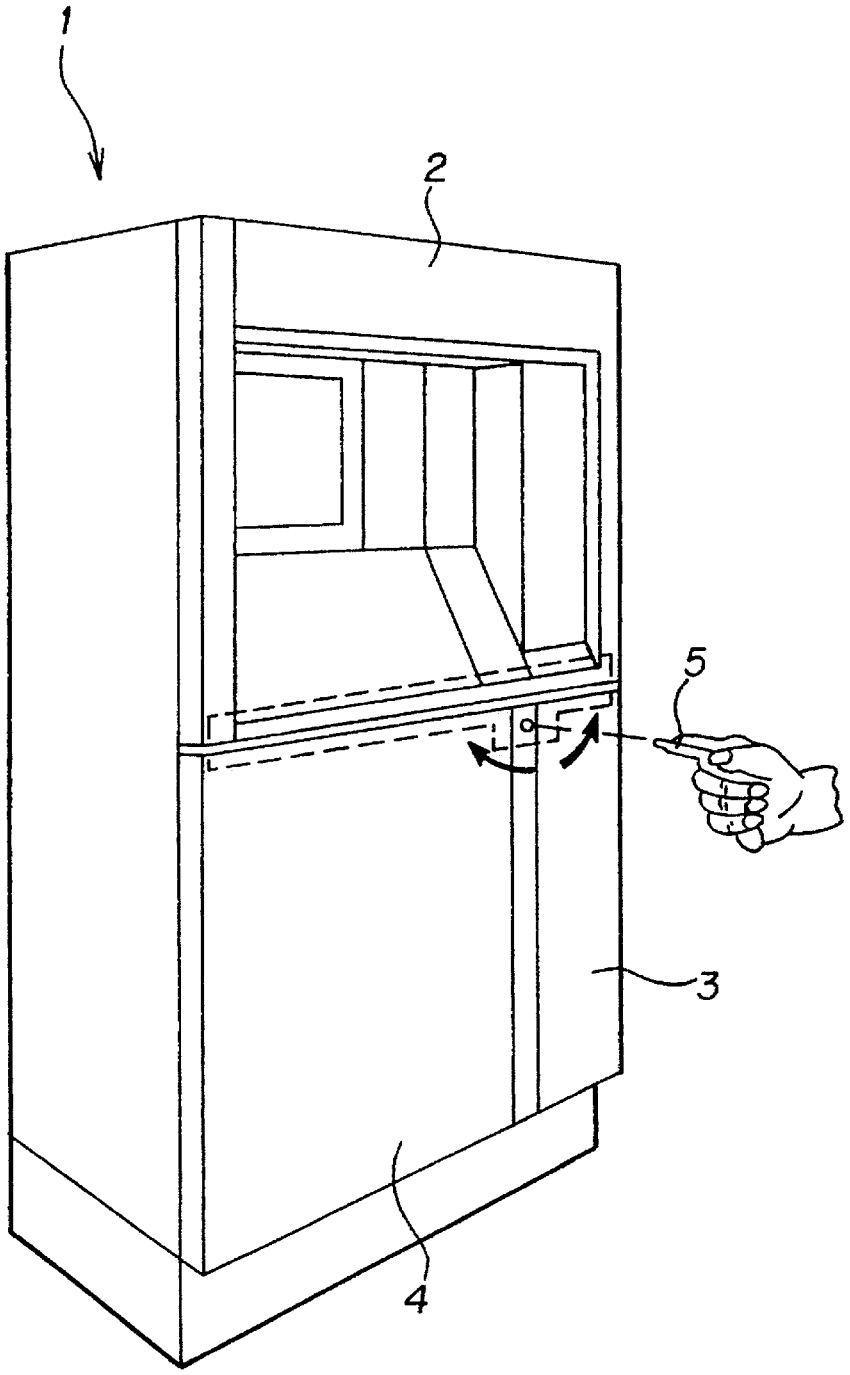
FIG. 1 is a perspective view of a dispenser for tickets to which the invention is applied.

Referring to FIG. 1, a perspective view of a ticket dispenser (for train or subway) with the general reference numeral 1 is shown in schematic manner. The apparatus 1 is of generally rectangular block form and has dimensions of, for example, height: 195 cm, width 110 cm and depth 60 cm. The weight of such apparatus may amount to 500 kg. The apparatus 1 includes three doors 2, 3, 4 on its front, hinged on the apparatus and adapted to be opened and closed by means of a locking unit 12 (see FIG. 4). This locking unit 12 is operated by a special type of handle or socket driver 5 (referred to hereinafter as a "handle") which fits into opening 12B and enables movement of rod 13 (see FIGS. 3 and 4) in different directions and by different amounts, as explained below. Locking unit 12 can be locked by applying a mechanical locking device, for example, such as different keys for different functions in relation to the doors that are to be opened or closed. Locking unit 12 can also be, for example, an electronic locking device that provides access to one door or another depending on the user's rights.

A respective enclosure inside the apparatus 1 is associated with each door 2, 3 and 4, each enclosure being provided inside with different devices or systems needed for the operation of the apparatus. For example, the door 2 in the upper part gives access to an enclosure called the "technical" enclosure, comprising the assembly of means enabling the apparatus to operate, such as for example, electronic and mechanical means enabling operation and dispensing of the tickets and the supply of energy to electronic devices of the dispenser. The lower right door with the reference 3 gives access to the "cashbox" part containing means for storing money fed in by the users. Finally the door 4 (on the lower left hand side) gives access to an enclosure called the "ticket" enclosure, in which are located the means for storing tickets, the printing means and the means dispensing the tickets.

Figure 2A:
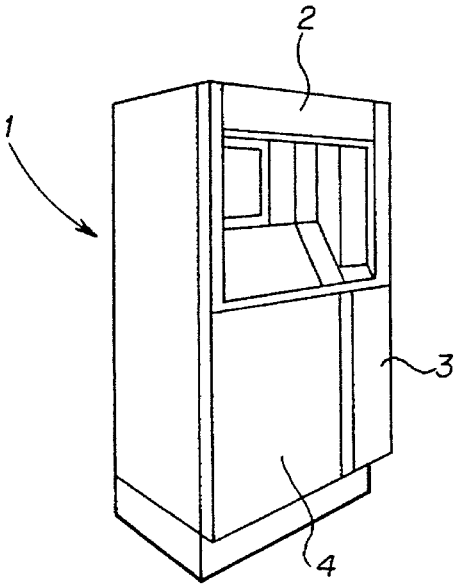
FIGS. 2A, 2B, 2C and 2D show the apparatus of FIG. 1 to a reduced scale for different positions of the doors.
Figure 2B:
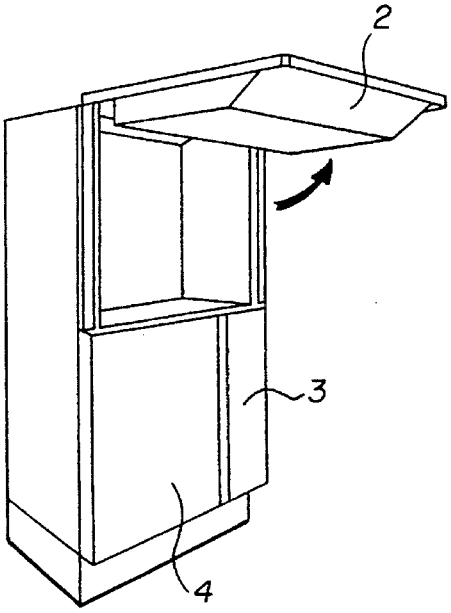
Figure 2C:
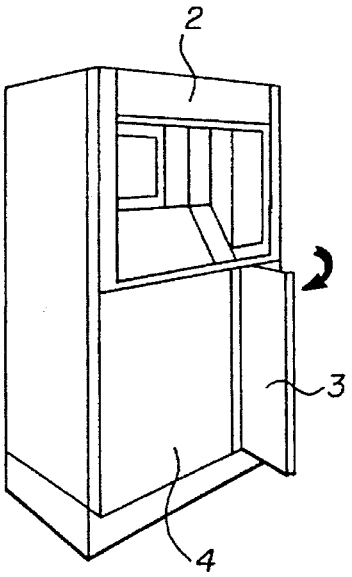
Figure 2D:
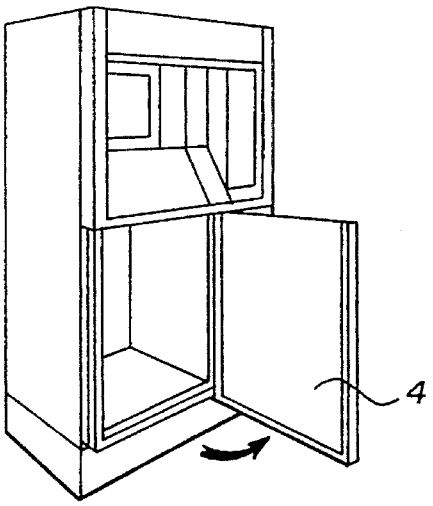

FIG. 2A shows the apparatus 1 with all doors closed. FIGS. 2B, 2C and 2D show the apparatus with the doors 2, 3 and 4 respectively open, the arrow in each figure showing the direction in which the corresponding door opens. In the example shown, the upper door 2 (technical) is mounted on a horizontal hinge axis located at the upper edge of the said door 2, while the door 3 (cashbox) is hinged about a vertical axis at the left edge of the door 3, and finally the door 4 (tickets) is hinged about a vertical axis at the right side of the door 4. The vertical hinge axes of the doors 3 and 4 are next to one another.

The locking and unlocking of the doors, starting from their closed position, such as is shown in FIGS. 1 and 2A, is described more particularly below with reference to FIGS. 3 to 8.

Figure 3:
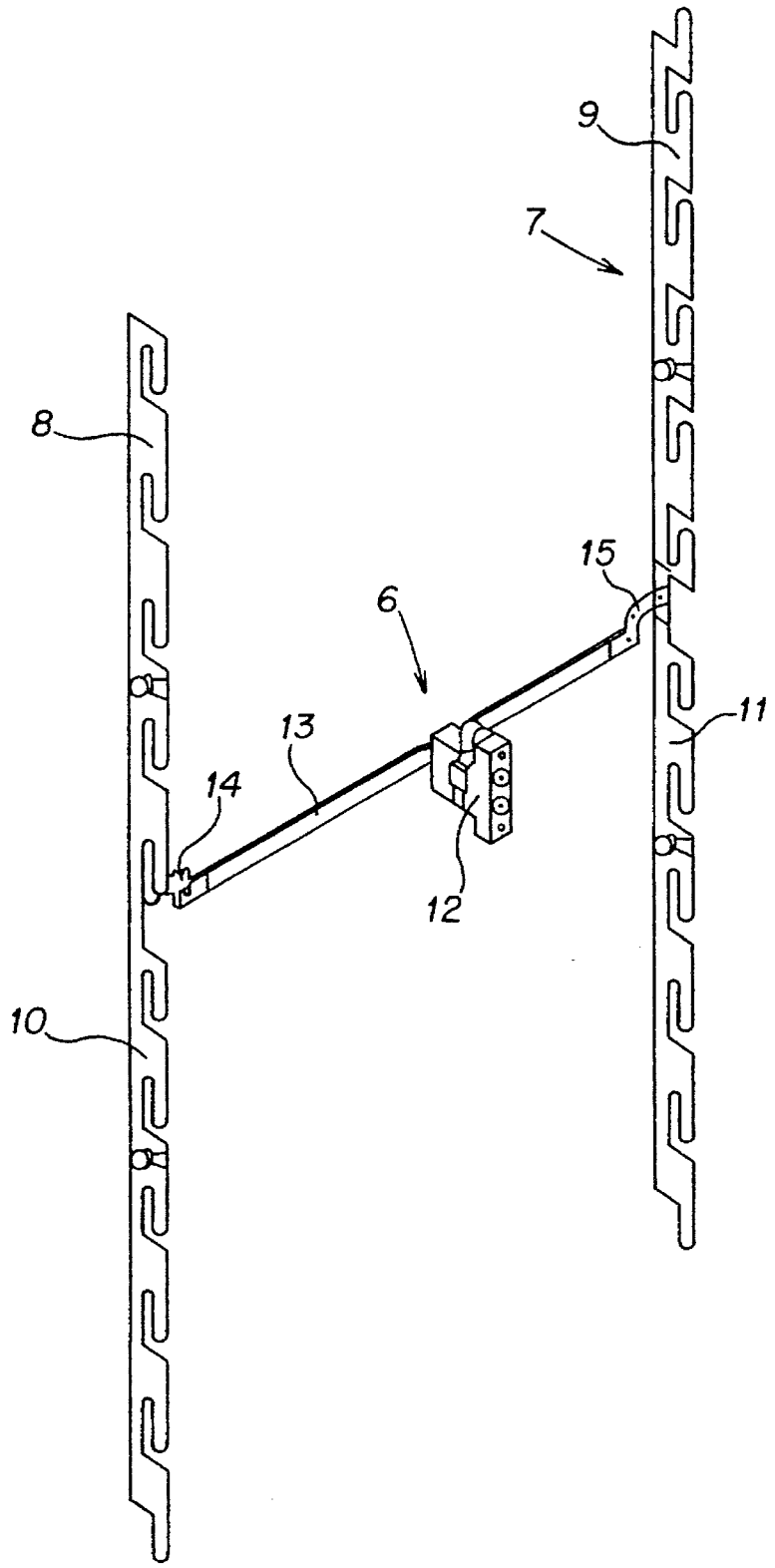
FIG. 3 shows the control means schematically in perspective, associated with closing bolts for the door.

As is shown in FIG. 3, the device of the invention comprises, firstly, single control means with the general reference 6 and, secondly, locking means for the doors, with the general reference 7. The locking means are formed by longitudinal parts in the form of bars, with the references 8, 9, 10 and 11.

The bars 8 and 10 are in alignment with each other and the bars 9 and 11 are in alignment with each other. The bar 8 is in alignment with and is integral with the bar 10, while the bar 9 is in alignment with and is integral with the bar 11. The bars 8 and 10 are parallel to the bars 9 and 11 and are spaced at a distance substantially making up the width of the dispenser 1. More particularly the bars 8 and 10 are located substantially at the edges of the corresponding doors, respectively 2 and 4, while the bars 9 and 11 are located substantially in the region of the corresponding edges respectively of the doors 2 and 3. From the mechanical point of view and in terms of their operation, the bars 8 and 10 form a single bar and the same applies to the bars 9 and 11.

Figure 4:
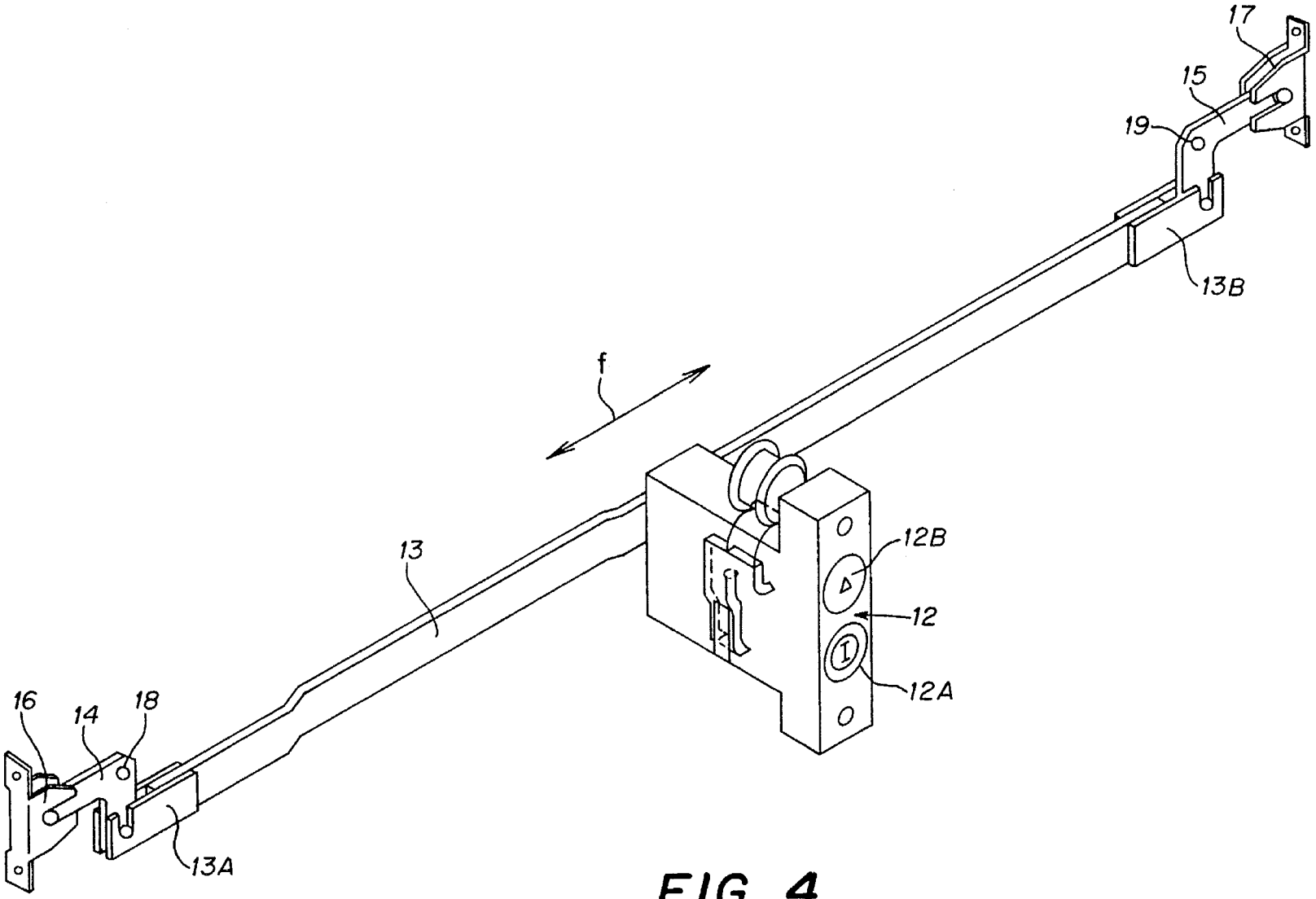
FIG. 4 is a detail view in perspective of the single control means adapted to actuate the locking means of the doors.

The single control means 6, shown in more detail in FIG. 4, comprises the locking unit 12 which can be locked against any operation to move rod 13 by a lock 12A. If lock 12A is unlocked, then handle 5 can be turned to control the translation parallel to itself of rod 13, preferably in both directions. The rod 13 is provided at its ends with articulated connecting members constituted by respective levers 14 and 15 and respective sliders 16 and 17. The levers 14 and 15 are mounted to rotate about respective axes 18 and 19 integral with the frame of the apparatus 1. The levers are in the general shape of an L, of which one free end is pivoted to the corresponding end 13A, 13B of the rod, while the other free end of the lever is coupled to the respective slider 16, 17 through a pivot pin engaging in a groove forming part of the slider. Each slider 16, 17 is provided with lugs for the passage of bolts, in order to fix the slider 16 to the bars 8 and 10 and the slider 17 to the bars 9 and 11.

The double arrow f (FIG. 4) shows the possible movements of the rod 13 which, thus, causes the levers 14 and 15 to rotate about their respective axes 18, 19, the levers in turn causing translation of the corresponding sliders 16 and 17 in directions substantially at right angles to the direction of movement of the rod 13. The rod 13 is disposed substantially horizontally and the sliders 16 and 17 are thus shifted in a substantially vertical direction, the same applying to the bars 8–11.

It will be understood that, with the mechanism of the control means described above, for a rotation of the key 5 in the clockwise direction for example, the rod 13 is shifted in a direction which causes the bars 8 and 10 to move downwards for example, while the bars 9 and 11 undergo movement in the opposite direction (upwards).

Figure 5:
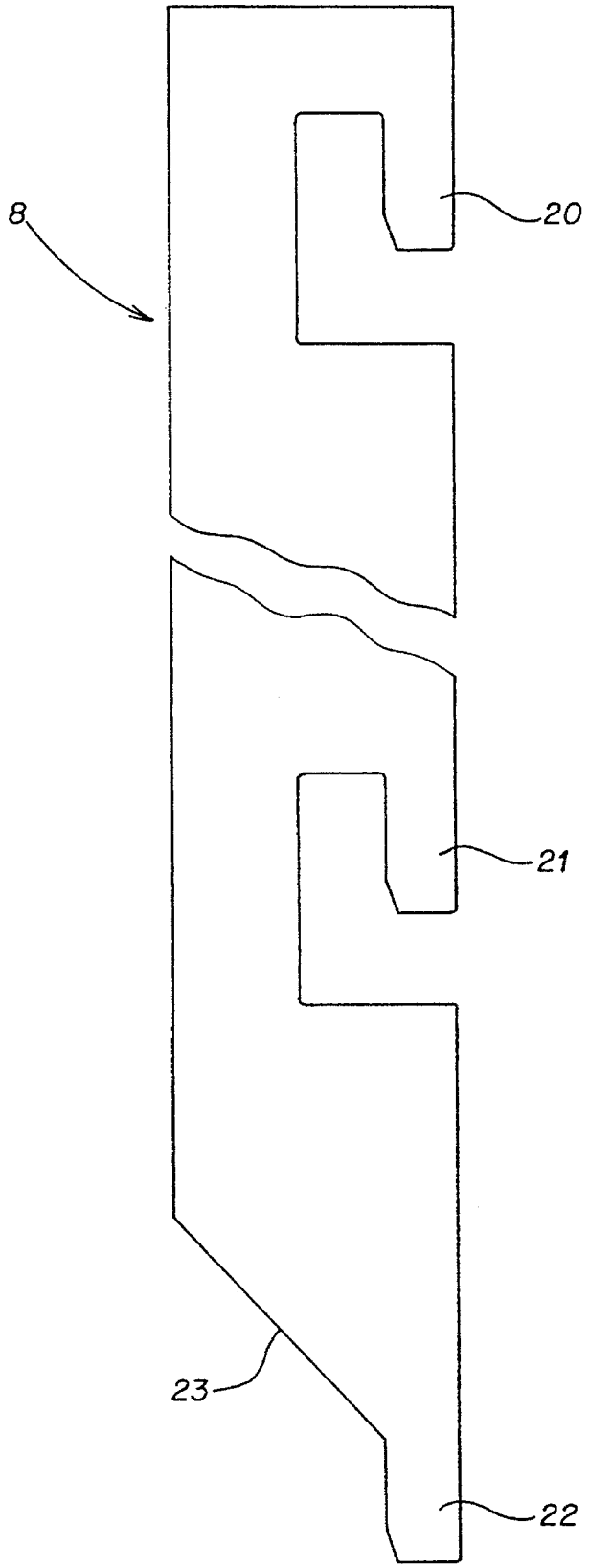
FIG. 5 is a side view of a bar provided with bolts.

The bars 8 to 11 are formed from metal parts of which one implementation is shown in detail in FIG. 5. The bar, for example the bar 8, is formed by an elongate section member comprising at least one finger, preferably a plurality of fingers, for example eight, of which three are shown in FIG. 5 with the references 20, 21 and 22. The finger 22 at the lower end of the bar 8 is formed by the bevelled off end 23 of the bar 8, while the other fingers forming bolts (20, 21) are formed by L-shaped cut-outs, matching the hook-shaped fingers 20 and 21.

Figure 6A:
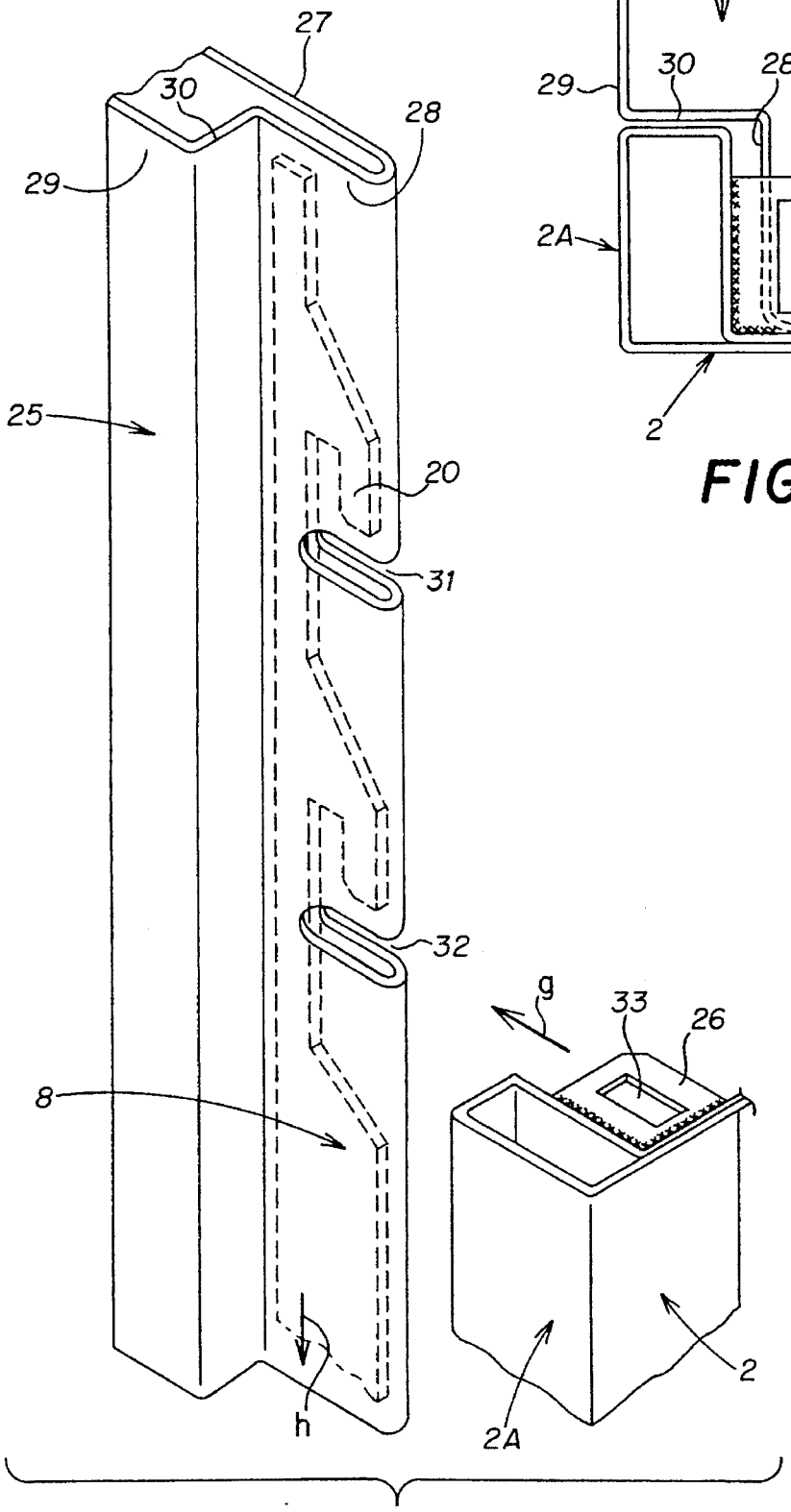
FIG. 6A is a perspective view showing the means for closing the doors.
Figure 6B:
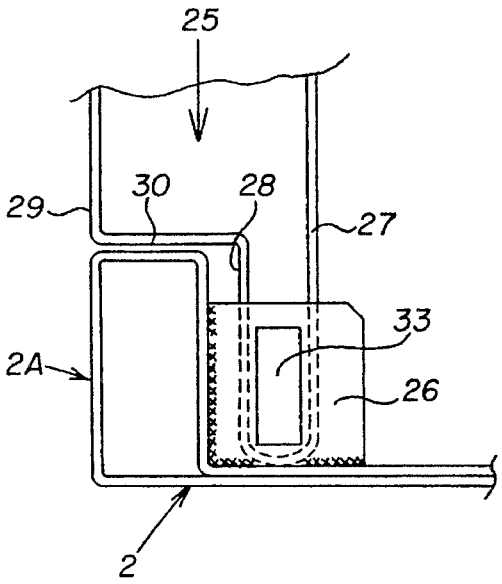
FIG. 6B is a cross section of the device of FIG. 6A, in the closed position of the door.
Figure 6C:
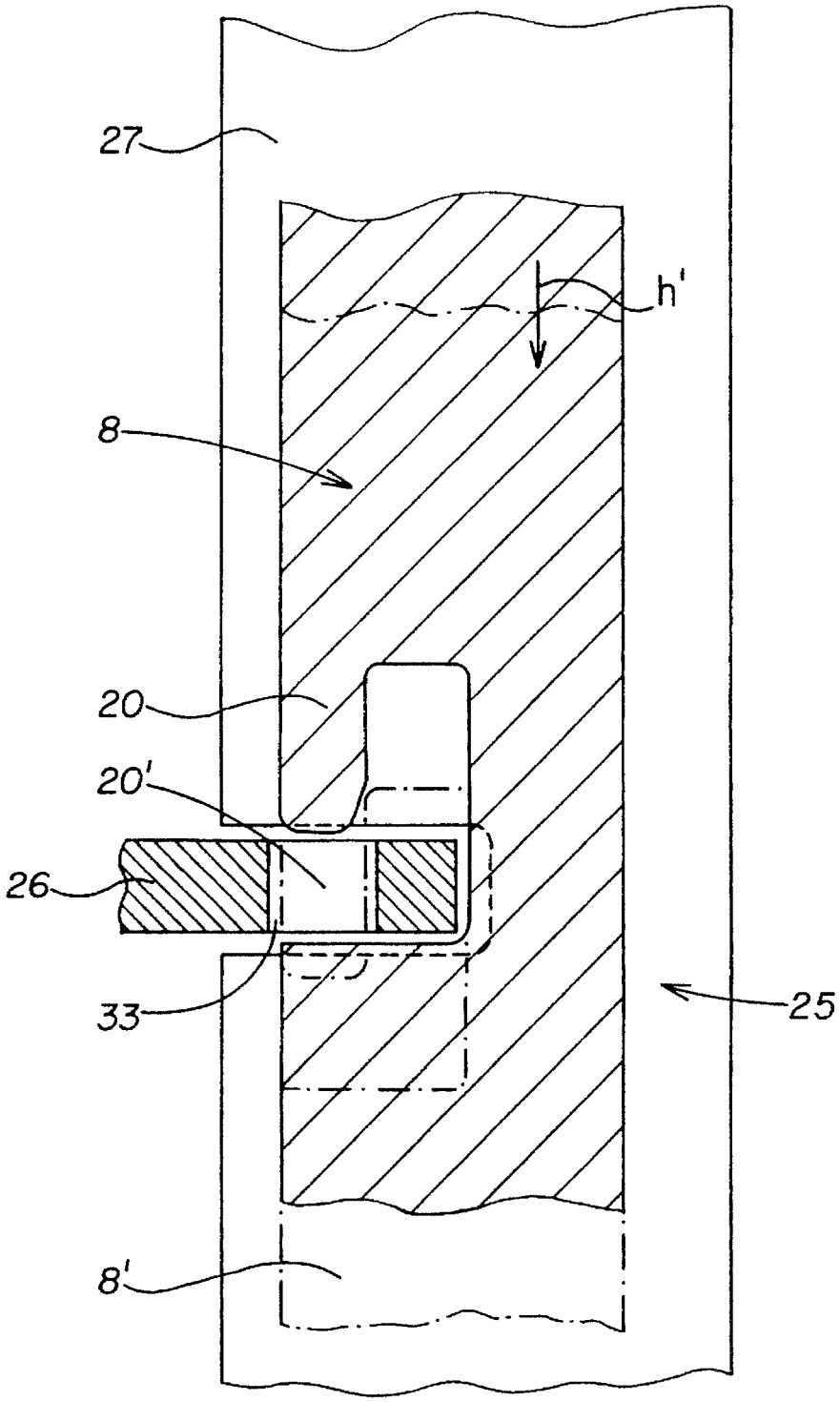
FIG. 6C is a longitudinal section of the closing means of FIG. 6A, in the closed position of the door.

The means for locking the doors in the closed position, provided by the bars having bolt-forming fingers, are described in more detail, especially in order to demonstrate their operation, with reference to FIGS. 6A, 6B and 6C. FIG. 6A shows schematically and in perspective a bar, such as the bar 8, adapted to be translated along its direction of elongation and constrained to do so by an elongate part 25. The elongate part 25 is integral with the frame of the apparatus 1 and, more particularly, is located near to the edge of the opening of the corresponding enclosure adapted to be closed by the corresponding door (2, 3 or 4). The locking means also comprise, for a given door, a set of horizontal tongues 26, of which only one is shown in FIG. 6A for reasons of simplicity. There is shown in section, to the right of one of the tongues, the free edge of the corresponding door, for example the door 2. The elongate part 25 associated with the locking bar 8 comprises a first wall 27 parallel to and facing a second wall formed in turn from two walls 28 and 29, the walls 28 and 29 being parallel to each other with their planes offset transversely and connected by a flange forming a shoulder 30. Thus, the walls 27 and 28 form a generally U-shaped housing, as shown in section by FIG. 6B, in which the corresponding bar is adapted to move in a longitudinal direction, namely the bar 8 in FIGS. 6A, 6B and 6C. The elongate part 25, comprises notches in the U-shaped part formed by the walls 27 and 28 which receive the bar 8, two of which notches are visible in FIG. 6A, with the references 31 and 32. The notches have a height, in the longitudinal direction of the elongate part 25 substantially equal to but slightly greater than the thickness of the tongues 26 provided on the doors. Thus, in the closed position of the doors, after having moved the door along arrow g in FIG. 6A, the corresponding tongues engage in the notches 31 and 32, while the extreme edge or flange 2A of the door 2, beside the tongues 26, has a solid part adapted to face the flange 30 of the elongate part 25 and lodge in the space defined thereby (see FIG. 6B).

The tongues 26 are each provided with an opening 33 of such a shape and position that, with the door in the closed position (FIG. 6B), the opening 33 of each tongue 26 will be substantially contained within the U formed by the walls 27 and 28 of the elongate member 25, the said U forming the receiving seat for the corresponding bar. Note that the bar has not been shown in FIG. 6B, for reasons of convenience.

It will be understood that, starting from the position of FIG. 6B, that is to say with the door closed, movement of the bar 8 along arrow h (FIG. 6A) causes movement of the bolts 20 and 21 which penetrate the openings 33 provided in the tongues 26 and, thus, lock the corresponding door.

FIG. 6C shows the bolt 20 of the bar 8 from the side in a retracted position, and the same bolt 20' of the displaced bar 8' in the locking position in which it is seen that the bolt 20' has penetrated the interior of the seat 33 and, thus, locked the door against turning, since the bolt located inside the opening 33 prevents movement of the tongue 26. The same applies to each of the tongues 26 associated with each bolt for a given bar and for a given door. FIG. 6C only shows part of the locking means for a given door, for ease of understanding, namely one bolt and one corresponding tongue.

Figure 7A:
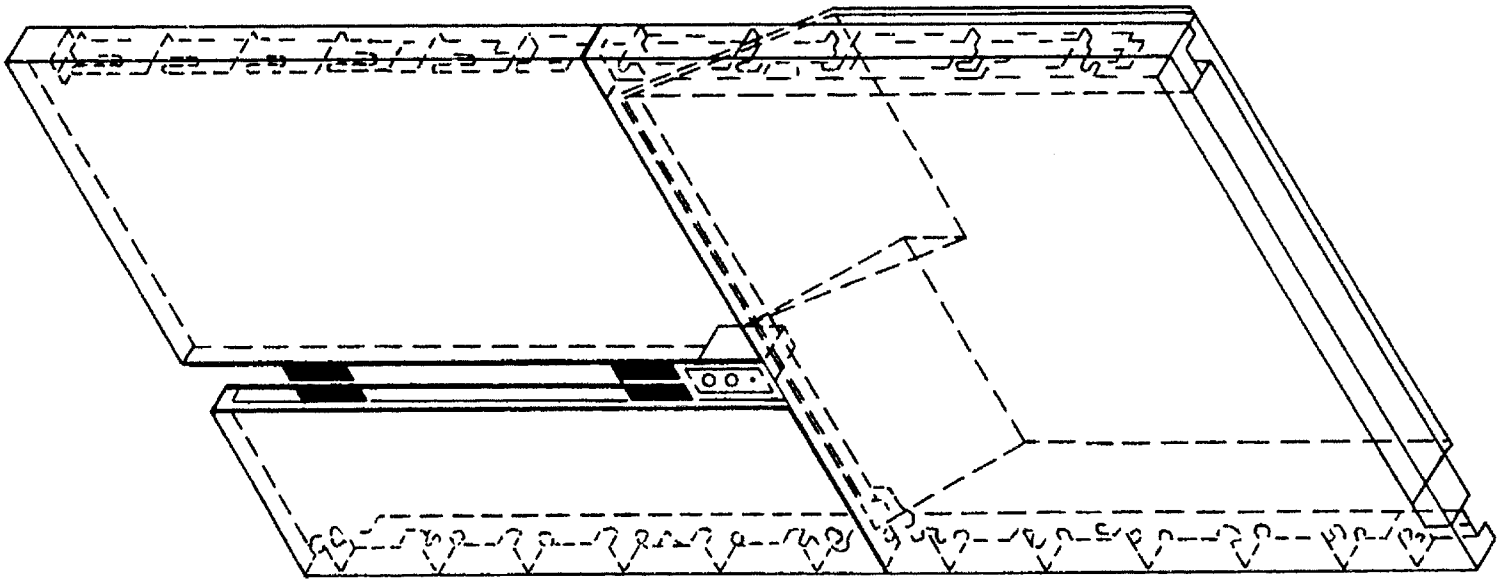
FIGS. 7A, 7B, 7C and 7D show the means locking and opening the doors in perspective for each door shown open.
Figure 7B:
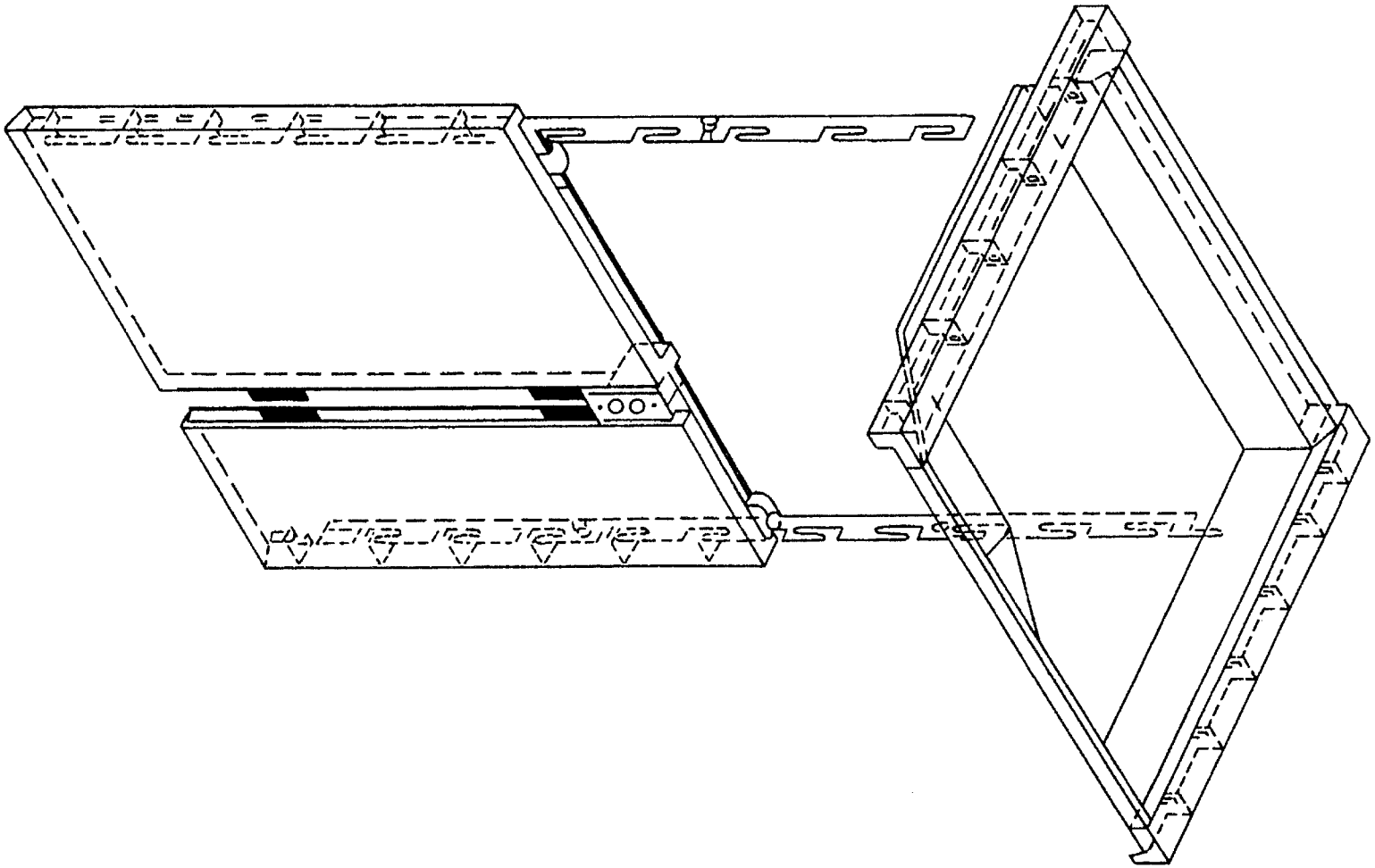
Figure 7C:
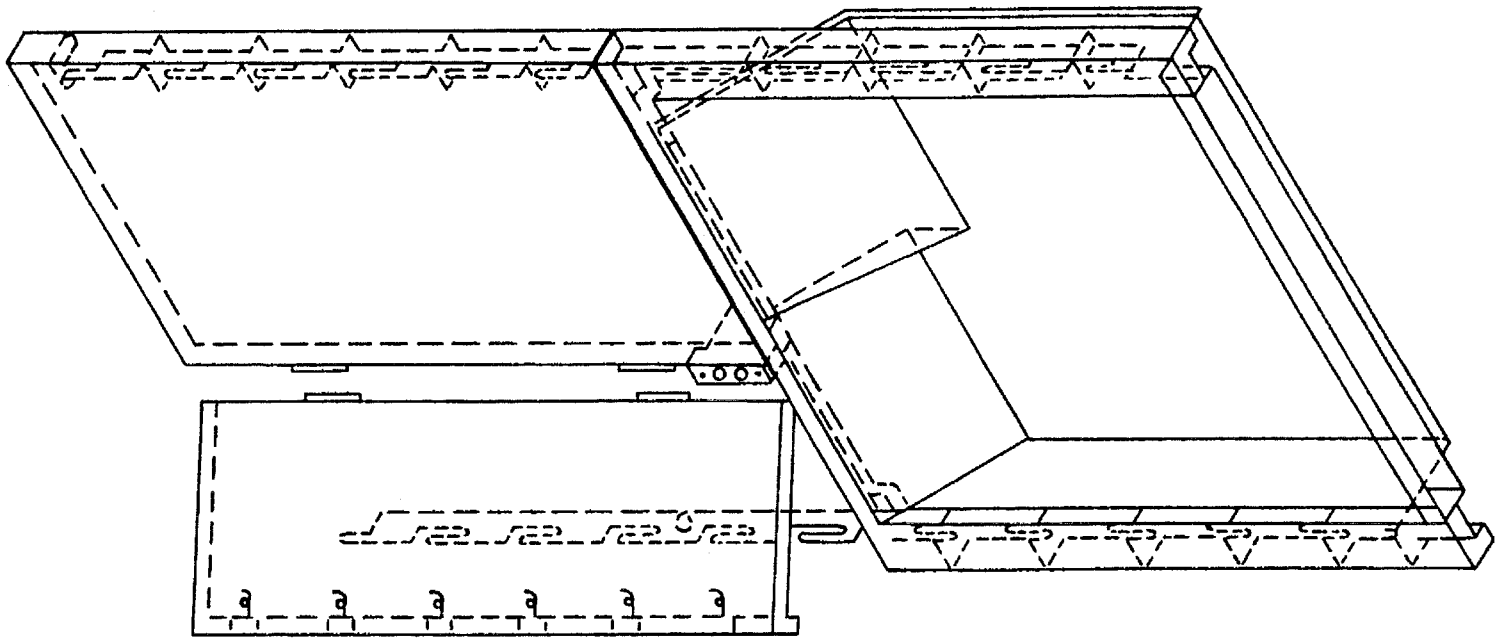
Figure 7D:
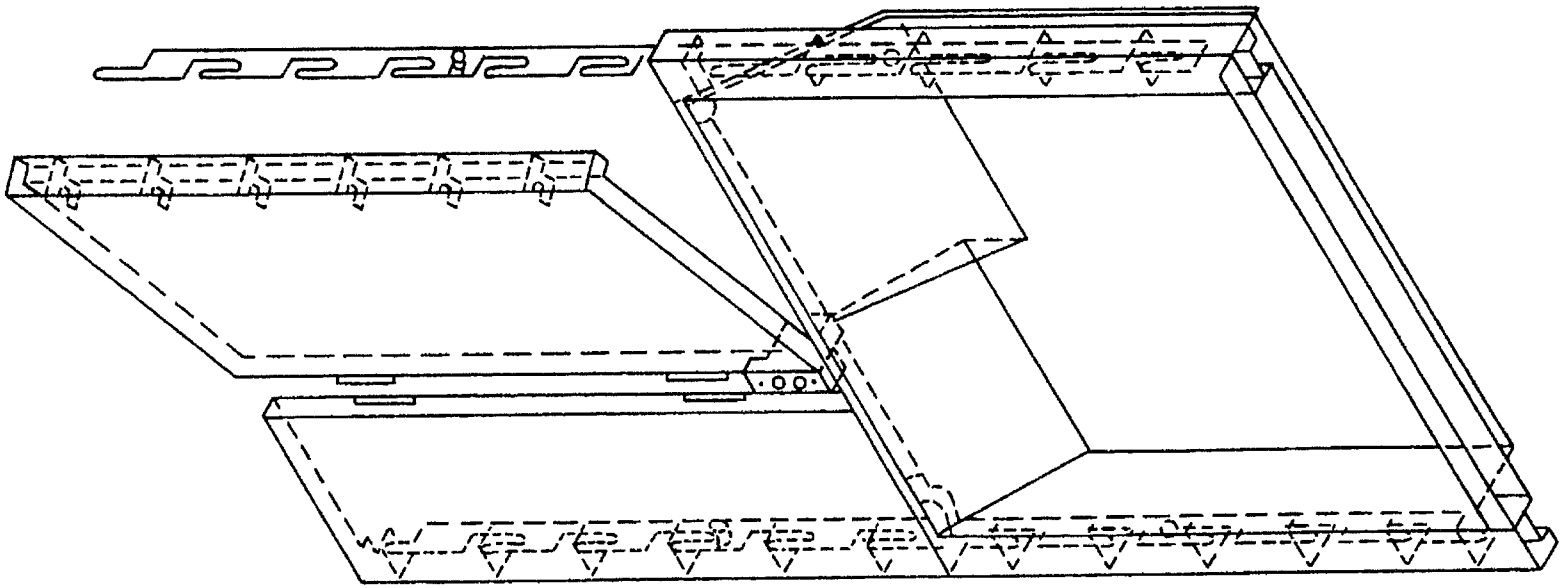

With reference to FIG. 3, it is seen that the bolts of the bars 8 to 11 are disposed in different directions, more precisely the bolts of the bars 8, 10 and 11 are directed downwards while the bolts of the bar 9 are directed upwards. This makes it possible to close or unlock the doors 2, 3 and 4 in a predetermined order, taking into account the respective and differing movements of the bars 8 and 10 on the one hand and 9 and 11 on the other. FIGS. 7A to 7D show the front face of the apparatus 1 and in particular the three doors associated with their respective locking means, for each position of the locking means. FIG. 7A shows the apparatus when the three doors are closed and barred, i.e. the bolts of the bars 8 to 11 are located inside the openings 33 provided in the tongues 26 fixed to the doors. A given turning movement of the key makes it possible to unlock the door 2, by movement of the bar 8 upwards and of the bar 9 downwards, which moves the corresponding bolts in directions such that they move out from the openings 33 and, thus, free the door 2, which is shown in open position in FIG. 7B. Note that, in this position, the two other doors 3 and 4 are kept closed, the upward movement of the bar 10 associated with the door 4 not allowing the door 4 to be unlocked, and the downward movement of the bar 11 likewise not allowing the door 3 to be unlocked.

The movement of the key is continued in the same direction or carried out in the opposite direction and then allows the door 3 for example to be unlocked (FIG. 7C), through opposite movements of the bars, while the other two doors are kept closed. Likewise, complementary and additional movement of the key 5 allows the door 4 to be unlocked (FIG. 7D) while the two other doors are kept closed.

The means enabling the doors to be closed and unlocked successively and in a controlled and hierarchical manner are explained in more detail below, more particularly with reference to FIGS. 8A, 8B, 8C and 8D, showing an embodiment of the bars, more specifically a part of the latter. For each FIG. 8 there are shown two bars 8/10 and 9/11 in different respective position of the bars, i.e. for the different respective position for opening the doors like the doors 2, 3 and 4 of the apparatus 1. The members and parts of FIGS. 8 like those of the other figures (in particular FIGS. 1, 2, 3, 6) are given the same or similar references. Thus, the respective bars 8/10 and 9/11 correspond to those of FIG. 3. Each bar is provided with a bolt in the upper part and a bolt in the lower part. A tongue (like the tongue 26 of FIGS. 6A and 6C) fixed to the corresponding door is associated with each bolt. A tongue and, thus, a door corresponds to each bolt. The last digit of the reference numeral of each part or member refers to the reference for the corresponding door (2, 3 or 4 of FIGS. 1 and 2). For example, the bolt 204, the tongue 264 and the opening 334 provided in the latter pertain all three to the door 4. For reasons of clarity, only a single bolt has been shown on each bar for the corresponding door, with the exception of the door 2, associated with two bolts located on two bars respectively located on the two sides of the door 2.

Figure 8A:
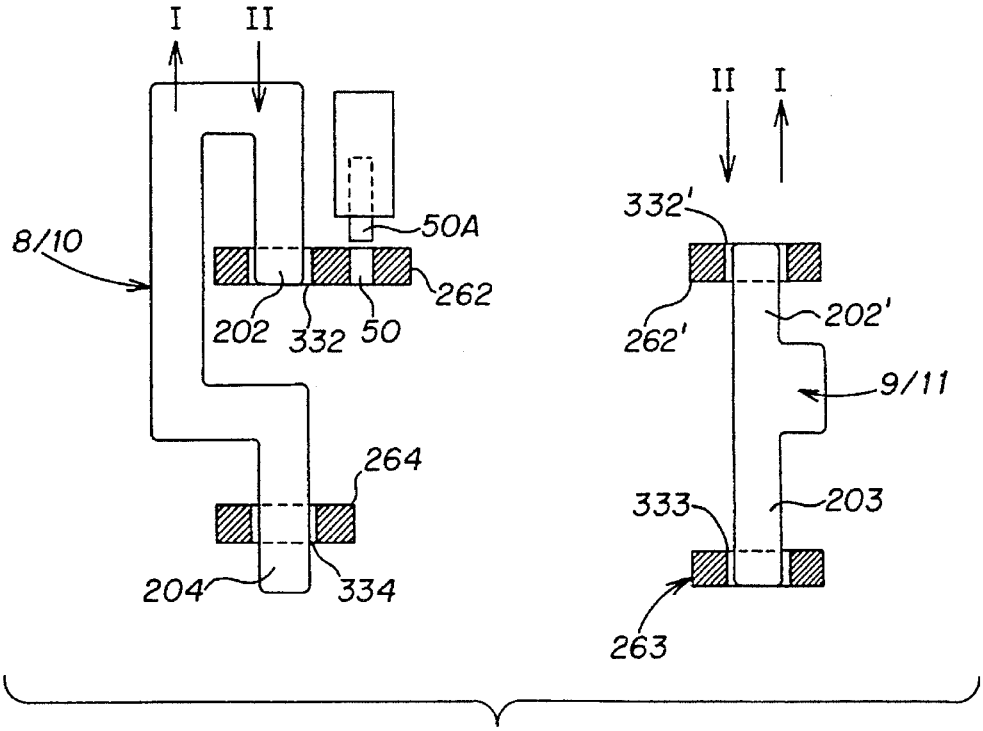
FIGS. 8A, 8B, 8C and 8D show schematically the positions in side view of the two bars for the three doors, respectively. of the apparatus of FIG. 1, and the open and closed positions of the latter.

In the left hand part of FIG. 8A there is shown a first bar 8/10, while a second bar 9/11 is shown in the right part. The bar 8/10 comprises two down-turned bolts 202 and 204 while the bar 9/11 comprises one up-turned bolt 202' and one down-turned bolt 203. The bar 8/10 is associated with two tongues 262 and 264 while the bar 9/11 is associated with two tongues 262' and 263. Each tongue has an opening with the respective references 332, 332', 333 and 334, the said openings being of such shape and dimensions that they allow the respective bolts 202, 202', 203 and 204 to penetrate, in the manner described with reference to FIG. 6A. The tongues 262 and 262' are fixed to the door 2, the tongue 263 to the door 3 and the tongue 264 to the door 4.

In the position such as is shown in FIG. 8A, the three doors 2, 3 and 4 corresponding to the tongues 202, 202', 203 and 204 are locked in the closed position, since the bolts are located inside the openings in the tongues fixed to the doors.

Figure 8B:
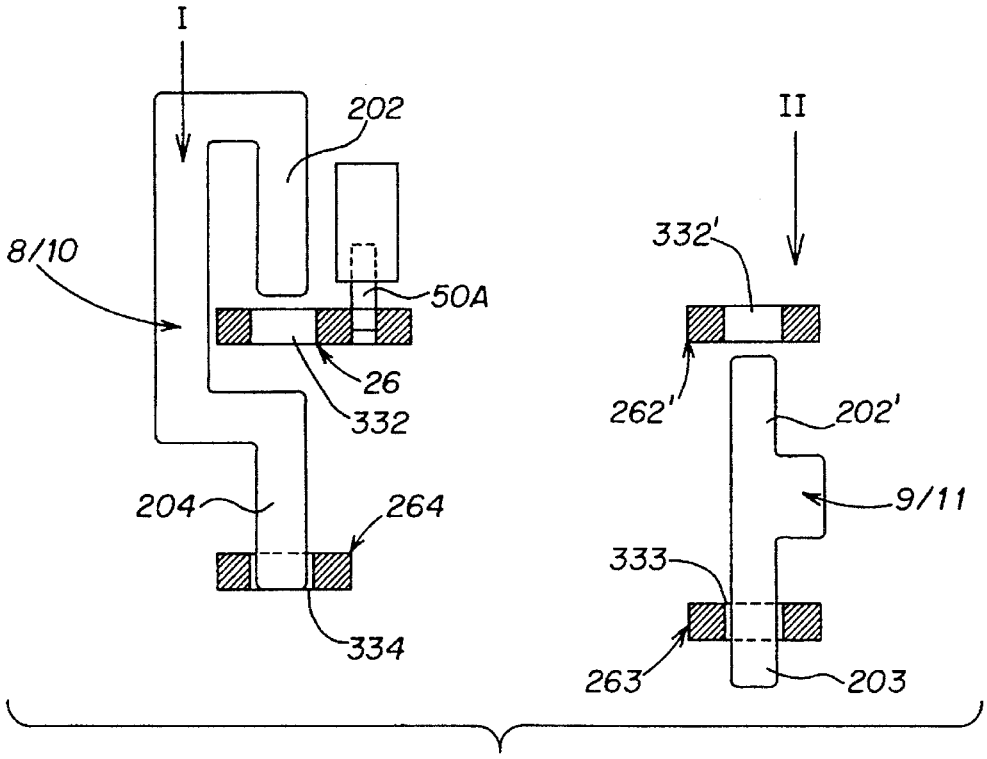

Starting from the locked position shown in FIG. 8A, the counterclockwise operation by the user of the lock 12 of the single control means causes the rod 13 (FIG. 4) to move in a given direction and, thus, causes the bar 8/10 to move upward in the direction of arrow I, while the bar 9/11 is moved downwards in the direction of arrow II, so that a position shown in FIG. 8B is reached. The vertical movements (upwards and downwards, respectively) of the bars are by a given increment of length, more specifically by a length slightly greater than the thickness of the tongues 262, 262', 263 and 264. Thus, as shown in FIG. 8B, the bolt 202 is disengaged from the opening 332 of the tongue 262. The same is true of the bolt 202' moved out of the opening 332' of the tongue 262'. Accordingly, the door 2 is capable of being opened. The concomitant downward movement of the bar 9/11 does not allow the corresponding door 3 to be unlocked, and it stays locked.

The transition from the position shown in FIG. 8A, in which all the doors are closed, to the position shown in FIG. 8B, in which only the door 2 is open, has been effected by rotation of the handle 5 in the locking unit 12 through a fraction of a turn, in the given direction (for example counterclockwise).

Figure 8C:
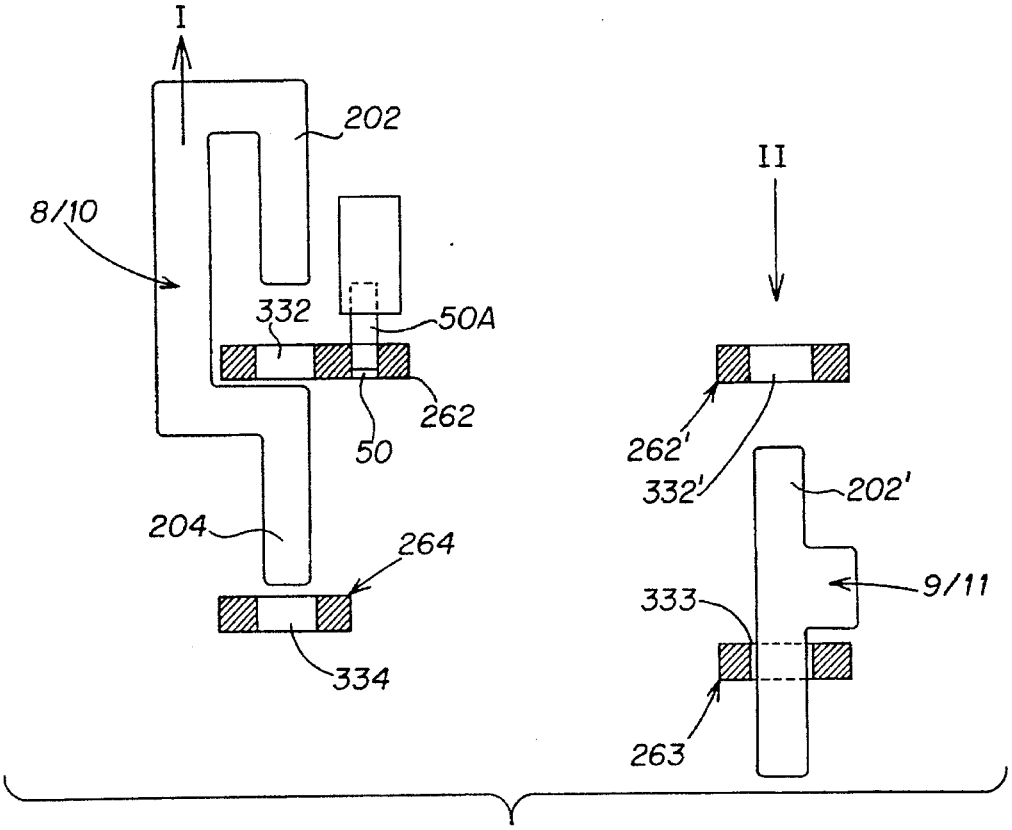

In order to release another door, for example the door 4, the user, starting from FIG. 8A (in which all the doors are closed) turns the key in the same direction as in the preceding operation (i.e. counterclockwise) through two fractions of a turn (say through two quarter turns). The position shown in FIG. 8C is reached, in which the movements of the bars 8/10 and 9/11 according to the arrows I and II have allowed the door 4 to be freed, while keeping the door 3 closed, (the door 2 being also open).

Figure 8D:
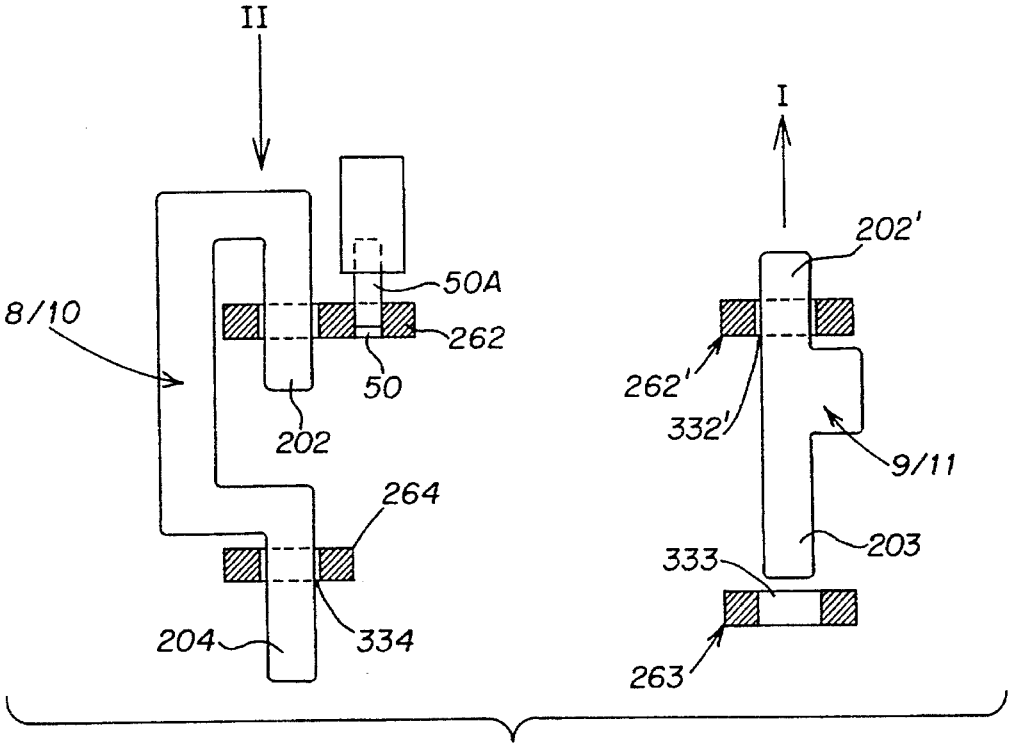

Starting from the position shown in FIG. 8A (all doors closed), the user turns the key in the opposite direction (e.g. clockwise) to that in the preceding operations, through one fraction of a turn, in order to reach a fourth position such as is shown in FIG. 8D. The bars are shifted in a downward direction (arrow II) for the bar 8/10 and upward (arrow I) for the bar 9/11. Thus, the doors 2 and 4 are kept closed, while the door 3 is unlocked.

For each of the positions of the handle 5, by varying the direction or rotation and the number of increments of the fraction of a turn (for example in multiples of one fourth of a turn), the opening of the corresponding doors is controlled in such a manner that, for each position, a single door will be open, while the other two are closed (or at least one other).

The table below shows the open state (O) or closed state (C) of the doors 2, 3 and 4 for each of the positions A to D relating to the corresponding FIGS. 8A to 8D:

| Position | 2 | 3 | 4 |
|---|---|---|---|
| A | C | C | C |
| B | O | C | C |
| C | O | C | O |
| D | C | O | C |

As can be seen from the table above, in the position C, the doors 2 and 4 are unlocked at the same time, although the situation is that the person opening the door 4 should normally have access only to the enclosure accessible by the door 4, access to the enclosure controlled by the door 2 not being granted to him.

To deal with this situation the device according to the invention is equipped with auxiliary locking means, adapted to lock the door 2 temporarily; these auxiliary means are, for example, formed by a pin 50A adapted to enter into a seat 50 provided in one of the tongues (262) of the door 2. The pin 50A is adapted to be operated by an electromagnet for example, as shown schematically in FIGS. 8A through 8D. Such an electromagnet could be controlled by the same electronic circuit which controls the access by an electronic locking device, as mentioned above.

The operation of the auxiliary locking means is as follows. The person given access to the enclosure corresponding to the door 4 has to turn the handle 5 in a given direction of rotation (counterclockwise) and through two increments of rotation, such as for example two quarter-turns, to reach the position C (FIG. 8C), in order to open the door 4 while keeping the doors 2 and 3 closed. However, during the rotation of the handle, after one increment of rotation (one fourth of a turn), it causes the bars to be shifted until they reach the position B, shown in FIG. 8B, in which the door 2 is open, which is normally not allowed since the person should not have access to this door but only to the door 4. Starting from the neutral position in which all the doors are closed (FIG. 8A), the auxiliary locking means, in the form of the pin 50A and associated electromagnet, are so disposed that pin 50A enters into the seat 50 of the tongue 262 and locks the corresponding door 2. Thus, during the passage from the position 8A to the position 8C, the door 2 is kept closed by pin 50A.

To gain access to the door 2, the user turns handle 5 counterclockwise in the lock 12 through a quarter turn. In this position (FIG. 8B), the doors 3 and 4 are kept closed by the corresponding bolts 203 and 204, while the door 2 is also kept closed by pin 50A located in the seat 50 of the bar 8/10, although the bolts 202 and 202' are free from the openings 332 and 332' of the tongues 262 and 262'. Independent operating means, enabled for example by an electronic memory card, are provided, being adapted to be actuated solely by an authorised person, that is to say in this case the person responsible for operations in the enclosure accessible through the door 2. Once the operations in this said enclosure are completed, closure of the three doors, i.e. return to the neutral position (FIG. 8A) causes reinsertion of the pin 50A into the seat 50 of the door 2 and the neutral position A shown in the table above is restored.

Note that, for reasons of understanding, only a part of each bar, a single bolt and a single locking tongue have been shown in FIGS. 8A, 8B, 8C and 8D. Obviously each bar has a plurality of bolts, each associated with a tongue provided on the corresponding door.

Figure 9:
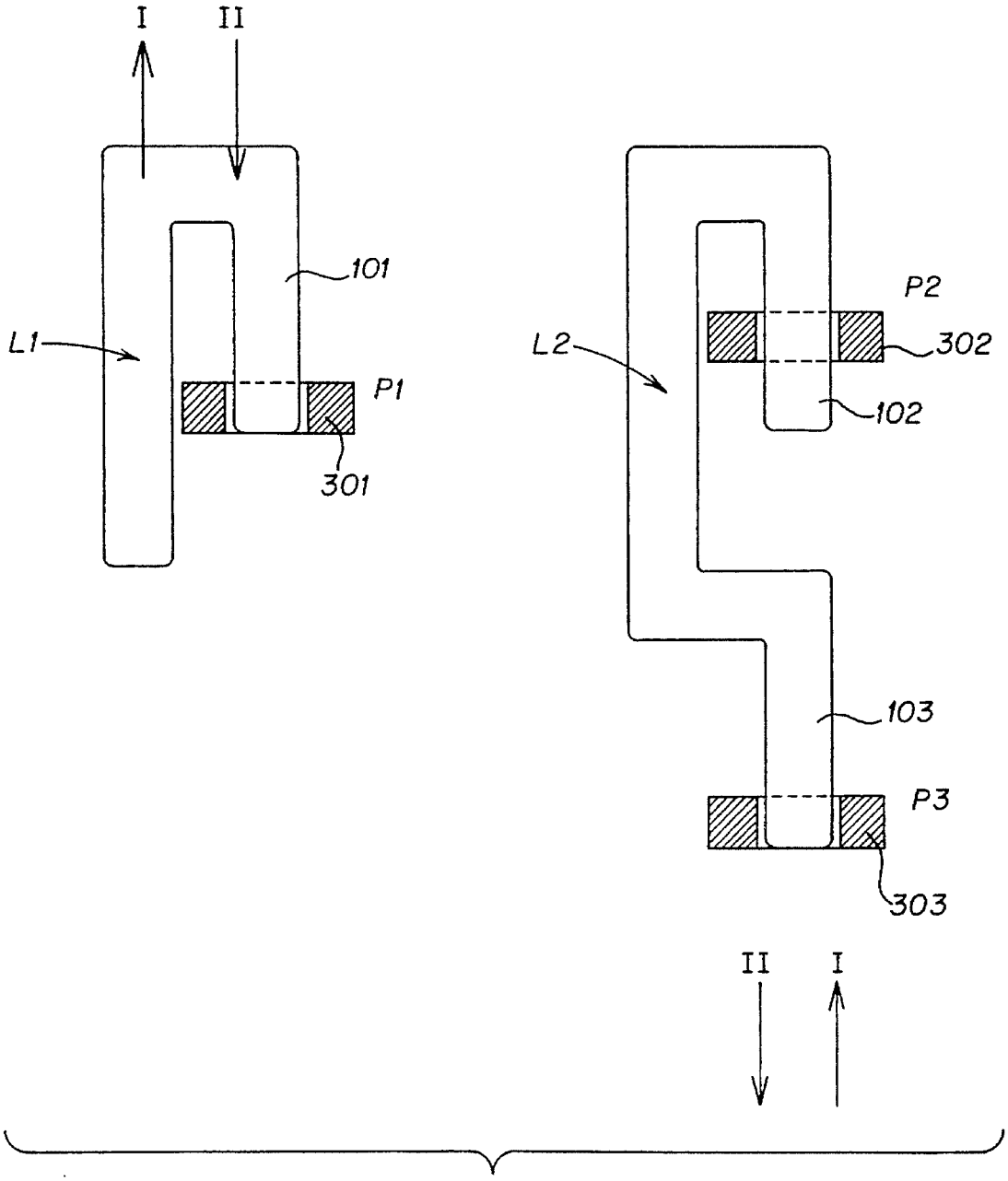
FIG. 9 shows another embodiment of three bolts associated with three doors respectively.
Figure 10B:
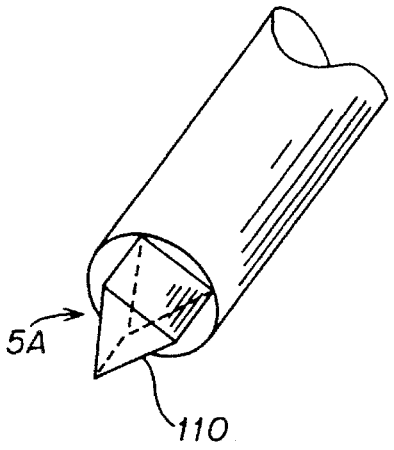
FIGS. 10A and 10B are a plan view and a perspective view, respectively, of one embodiment for handle 5 of FIG. 1.
Figure 10A:
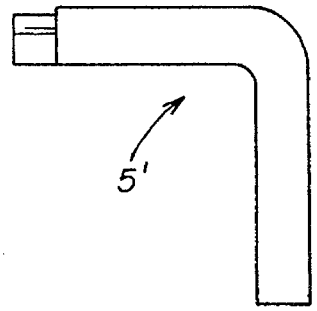

FIG. 9 shows another embodiment of the present invention. Bar L1 with a bolt 101 is associated with a tongue 301 of a door P1, a bar L2 with a bolt 102 is associated with a tongue 302 of a door P2, and a bolt 103 also on bar L2 is associated with a tongue 303 of a door P3. The movement of bars L1 and L2 is controlled by the single control means 6 shown in detail in FIG. 4 and explained above. Thus, control mechanism 6 causes bars L1 and L2 to move in opposite directions for a rotation of handle 5 in a given direction. Thus, as bar L1 moves upward in direction I, bar L2 moves downward in direction II, and vice versa. As in the previous embodiment, handle 5 is operable in predetermined increments to control the amount of movement of bars L1 and L2. The specific operation of this embodiment is described as follows.

As handle 5 is turned in the counterclockwise direction, for example, bar L1 will move upward in direction I, while bar L2 moves downward a corresponding amount in direction II. The amount of movement is sufficient to have bolt 101 just clear tongue 301. Thus, in this position door P1 is open, whereas doors P2 and P3 remain closed because, by virtue of the movement of bar L2, bolts 102 and 103 respectively move deeper into the openings in tongues 302 and 303. When, however, handle 5 is turned in the clockwise direction for a first increment, bar L1 moves downward along direction II, while bar L2 moves upward along direction I. The amount of movement is sufficient to have bolt 103 just clear tongue 303, thereby freeing door P3. When handle 5 is turned a further increment in the clockwise direction, bar L2 continues its upward motion along direction I so that bolt 102 clears tongue 302, thereby freeing door P2. Thus, in this position, doors P2 and P3 are both open.

By varying the parameters from one door to another, such as the orientation of the bolts (upward or downward), the direction of movement of the bolt (rising or falling), the length of the bolt and finally the amount of the displacement of the bolt per step (i.e. per increment of rotation of the handle 5), a large number of possible combinations can be created, allowing control of the opening and closing of the doors according to a predetermined sequence and hierarchy.

The reliability of the device and its security in use can be increased by assigning each person who is to have access to one enclosure only a key for opening 12B which only allows rotation of handle 5 in a given direction, preventing operation of the bars in an opposite direction.

Figure 11B:
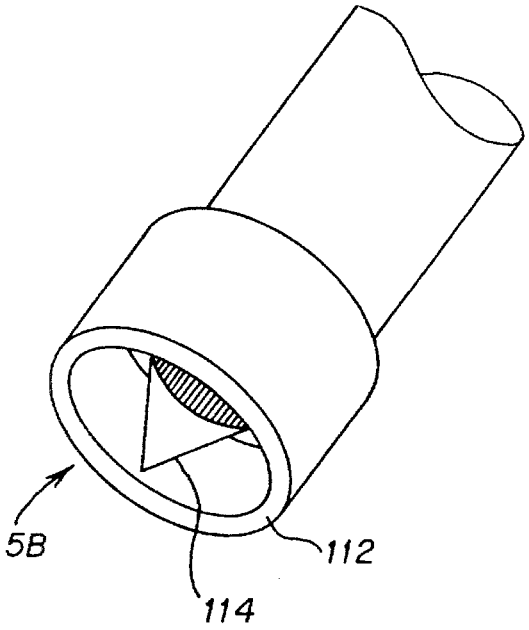
FIGS. 11A and 11B are a plan view and a perspective view, respectively, of another embodiment for handle 5 of FIG. 1.
Figure 11A:
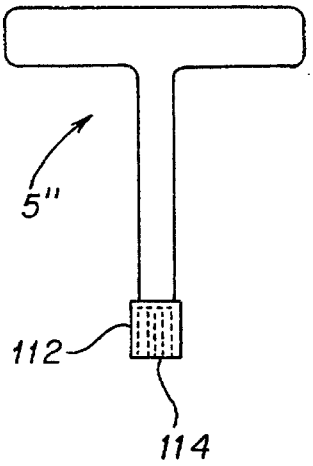

FIGS. 10A to 11B show two embodiments of handle 5. The operating end 5A of L-shaped handle 5' is shown in FIG. 10B to be a triangularly shaped protrusion 110 that fits into a similarly shaped opening 12B in locking unit 12. FIG. 11B shows the operating end 5B of T-shaped handle 5" to be a socket 112 accommodating within it a triangularly shaped actuator 114.

I claim:

1. A device for controlling opening and closing of at least two doors, each giving access to an enclosure through an opening thereof, comprising:

at least one receiving seat adapted to be provided on each door, locking means for keeping the doors closed or for releasing them, said locking means comprising at least two bars, each having a longitudinal axis and mounted to move along their longitudinal axes each provided with at least one finger forming a bolt and adapted to enter into a corresponding receiving seat, and a single control means for allowing separate and controlled access to each of the enclosures, and for operating said locking means for keeping the doors closed or for releasing them, in such a manner that the doors can be simultaneously either all closed or else at least one open and another closed, said control means comprising a rod having a longitudinal axis mounted to move parallel to its longitudinal axis to at least three positions and provided with two ends articulated to respective said bars by articulated connecting means for causing movement of said bars parallel to their longitudinal axis, such that said bar articulated at one end of said rod is moved in a different direction from said bar articulated at another end of said rod.

2. A device according to claim 1, having a plurality of said receiving seats wherein each of said bars is provided with a plurality of bolts corresponding respectively to said plurality of receiving seats.

3. A device according to claim 1, further comprising additional locking means operable independently of said first-mentioned locking means for one of the doors, in a manner allowing at least one door to be maintained in a closed position, regardless of whether said first-mentioned locking means are locked or unlocked.

4. A device according to claim 1, wherein there are a plurality of bolts on a common bar which are directed in different vertical directions.

5. A device according to claim 4, wherein there are a plurality of bolts on a common bar which are directed in different vertical directions.

6. A device according to claim 1, wherein said bolts are adapted to be moved in an incremental manner.

7. A device according to claim 6, wherein there are a plurality of bolts on a common bar which are directed in different vertical directions.

8. A device according to claim 6, further comprising additional locking means operable independently of said first-mentioned locking means for one of the doors, in a manner allowing at least one door to be maintained in a closed position, regardless of whether said first-mentioned locking means are locked or unlocked.

9. A device according to claim 1, wherein:

each said bar is disposed vertically and is adapted to move in a substantially vertical direction, said rod is mounted horizontally, and said connecting means are each formed by a lever having an L-shape formed by two arms, each having a free end, said free end of one arm being pivoted to said rod and said free end of said other arm being coupled to a slider integral with a respective said bar.

10. A device according to claim 9, having a plurality of said receiving seats wherein each of said bars is provided with a plurality of bolts corresponding respectively to said plurality of receiving seats.

11. A device according to claim 9, further comprising additional locking means operable independently of said first-mentioned locking means for one of the doors, in a manner allowing at least one door to be maintained in a closed position, regardless of whether said first-mentioned locking means are locked or unlocked.

12. A device according to claim 9, wherein there are a plurality of bolts on a common bar which are directed in different vertical directions.

13. A device according to claim 9, wherein said bolts have different lengths.

14. A device according to claim 9, wherein said bolts are adapted to be moved in an incremental manner.

15. A device according to claim 1, wherein said bolts have different lengths.

16. A device according to claim 15, wherein said bolts are adapted to be moved in an incremental manner.

17. A device according to claim 15, wherein there are a plurality of bolts on a common bar which are directed in different vertical directions.

18. A device according to claim 15, further comprising additional locking means operable independently of said first-mentioned locking means of one of the doors, in a manner allowing at least one door to be maintained in a closed position, regardless of whether said first-mentioned locking means are locked or unlocked.

19. A device according to claim 1, wherein there are a plurality of bolts on a common bar which are directed in different vertical directions.

* * * * *